US006236329B1

(12) United States Patent
Kyrtsos

(10) Patent No.: US 6,236,329 B1
(45) Date of Patent: May 22, 2001

(54) SLIDING VIBRATION WARNING SWITCH

(75) Inventor: Christos Kyrtsos, Southfield, MI (US)

(73) Assignee: Meritor Heavy Vehicle Systems, LLC, Troy, MI (US)

( * ) Notice: Subject to any disclaimer, the term of this patent is extended or adjusted under 35 U.S.C. 154(b) by 0 days.

(21) Appl. No.: 09/274,515

(22) Filed: Mar. 23, 1999

(51) Int. Cl.[7] ..... G08B 21/00

(52) U.S. Cl. ..... 340/683; 340/429; 340/540; 340/566; 340/669; 340/682

(58) Field of Search ..... 340/683, 681.1, 340/689, 686.3, 672, 665, 668, 669, 671, 429; 200/61.5, 61.48, 61.49

(56) References Cited

U.S. PATENT DOCUMENTS 4,237,454 * 12/1980 Meyer ..... 340/682
4,464,935 * 8/1984 McHugh ..... 73/660
5,034,729 * 7/1991 Lundquist ..... 340/683
5,686,669 * 11/1997 Hernandez et al. ..... 73/660
5,691,707 * 11/1997 Smith et al. ..... 340/682
5,880,351 * 3/1999 Orita et al. ..... 73/1.82
6,069,560 * 5/2000 Larsson ..... 340/540

* cited by examiner

*Primary Examiner*—Jeffery Hofsass
*Assistant Examiner*—Hung Nguyen
(74) *Attorney, Agent, or Firm*—Carlson, Gaskey & Olds, P.C.

(57) ABSTRACT

A vibration sensor includes a housing having an opening, and a movable trigger retained within the housing by a resilient member. The moveable trigger includes a projection of a dimension to fit at least partially through the opening. The resilient member retains the movable trigger within the housing until overcome by a predetermined acceleration. Whereas the moveable trigger is maintained within the housing the vibration sensor is minimally affected by radial acceleration while providing a calibrated resistance which must be overcome by an acceleration of predetermined severity along the measured direction. When the sensor experiences a predetermined acceleration, the trigger slides within the housing until the projection encounters the opening. The projection then "pops" through the opening such that the projection encounters a switch which awakes and activates a transmitter to send a signal to a warning device.

20 Claims, 2 Drawing Sheets

SLIDING VIBRATION WARNING SWITCH

BACKGROUND OF THE INVENTION

The present invention relates to an apparatus for detecting drive line system imbalances, and more particularly to a drive line vibration sensor which activates a warning when the drive line experiences a predetermined level of vibration.

A drive shaft typically includes an elongated tubular member which is operatively coupled to the transmission and axle assembly through a pair of universal joints or other similar coupling disposed on either end of the shaft. Alternatively, the drive shaft may include two or more elongated tubular members which are connected together by a universal joint or some other similar coupling device and connected between the transmission and wheel assembly.

The individual components of the drive line system discussed above often include inherent or residual imbalances due to variations in manufacturing tolerances. While steps can be taken to balance the individual components, residual imbalances often still remain. It is further known to balance the drive line system prior to, and after, installation into the vehicle. Typically, such balancing is effective to practically eliminate objectional vibration in the drive line system of a fully assembled vehicle. However, mechanical wear, residual imbalances, and road conditions may eventually lead to the disruption of the drive line balance. Vehicle drive line systems which become unbalanced are unacceptable as they produce drive line vibrations which could eventually lead to failure.

Accordingly, it is desirable to provide a vibration sensor which alerts an operator of the drive line imbalances as early as possible to prevent drive line damage from system vibration.

SUMMARY OF THE INVENTION

The present invention provides a vibration sensor which activates a warning when the drive line experiences a predetermined level of vibration.

The vibration sensor of the present invention is preferably fabricated using micro machining technology such that the sensor is preferably fabricated as an integrated circuit chip. Accordingly, the micro machined vibration sensor can be readily located in many small inaccessible locations of a vehicle drive line. The vibration sensor of the present invention generally includes a housing having an opening, and a movable trigger retained within the housing by a resilient member. The moveable trigger includes a projection of a dimension to fit at least partially through the opening.

The resilient member retains the movable trigger within the housing until overcome by a predetermined vibration level. Whereas the moveable trigger is maintained within the housing the vibration sensor is minimally affected by radial acceleration as the projection abuts the housing. The resilient member provides a calibrated resistance which must be overcome by a vibration of predetermined severity along the desired direction. The vibration level will be seen as an acceleration level at the sensor. Accordingly, the resilient member prevents the sensor from being activated until a sufficient acceleration in the measured direction is experienced.

If the sensor experiences a predetermined acceleration, the trigger slides within the housing until the projection encounters the opening. The projection then "pops" through the opening such that the projection closes a switch. The switch preferably awakes and activates a transmitter which sends a signal to a warning device. In an alternate embodiment, the warning device is hard wired to the sensor such that the trigger is configured to close an electric circuit when the projection encounters contacts wired to the warning device.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
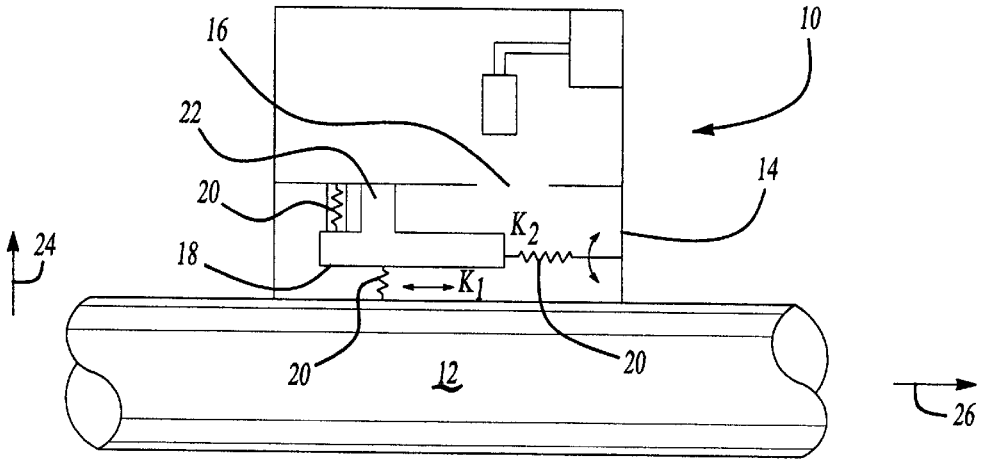
FIG. 1 is a general perspective view of a vibration sensor according to the present invention.

FIG. 1 illustrates a vibration sensor 10 according to the present invention. The vibration sensor 10 is preferably attached to a drive line (shown rather schematically at 12) such as a drive shaft, connecting shaft, half-shaft or the like. The sensor 10 of the present invention is equally applicable to other types of rotating machinery or bearings which tend to become unbalanced and eventually produce undesirable vibrations. The vibration sensor 10 of the present invention is preferably fabricated using micro machining technology in accordance with known integrated circuit technology. Accordingly, the micro machined vibration sensor can be readily located in many small otherwise inaccessible locations of a vehicle drive line.

The vibration sensor 10 generally includes a housing 14 having an opening 16, and a movable trigger 18 retained within the housing 14 by a resilient member 20. The moveable trigger includes a projection 22 of a dimension to fit at least partially through the opening 16. The vibration sensor 10 is shown in a position which is minimally affected by radial acceleration (shown schematically by arrow 24) yet, remains sensitive to longitudinal accelerations (shown schematically by arrow 26) due to drive line 12 vibration. Although a single vibration sensor 10 is shown and described, one skilled in the art will realize that a plurality of vibration sensors 10 can be located in various locations and positions along the drive line 12 to identify vibrations from multiple locations and along several axes.

The resilient member 20 retains the movable trigger 18 within the housing until overcome by a predetermined acceleration. Moveable trigger 18 is maintained within the housing 14 the vibration sensor 10 and is minimally affected by radial acceleration 24 as the projection 22 abuts the housing 14. Therefore, irrespective of the quantity of radial acceleration 24, the trigger 18 is retained in place and the sensor 10 remains inactivated.

The resilient member 20 provides a calibrated resistance which must be overcome by an acceleration of predetermined severity along the measured direction. Accordingly, the resilient member 20 prevents the sensor 10 from being activated until a sufficient acceleration in the measured direction is experienced. As illustrated in FIG. 1, the trigger 18 remains in place until a predetermined longitudinal acceleration 26 is experienced by the sensor.

Figure 2:
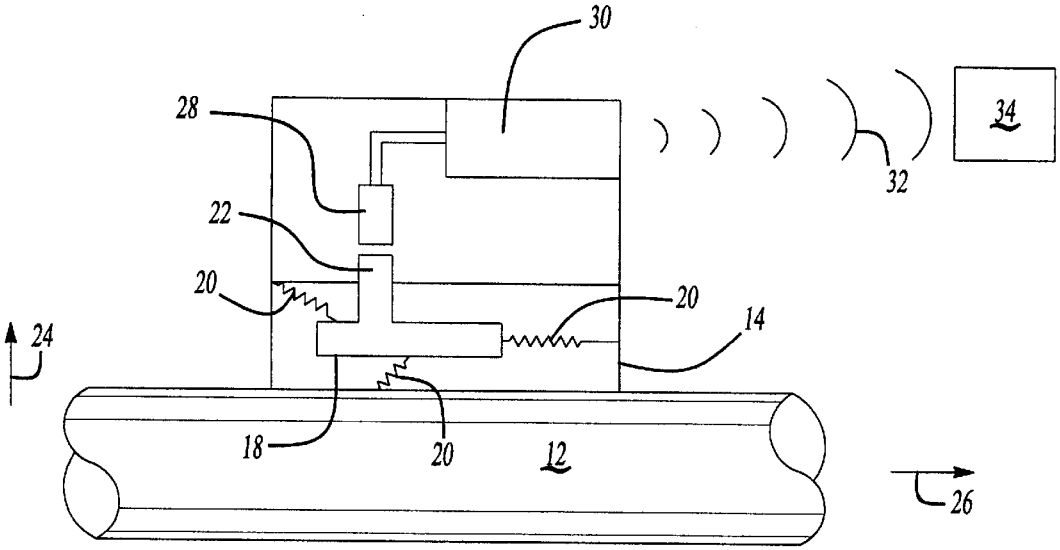
FIG. 2 is a general perspective view of a vibration sensor of FIG. 1 in the activated position.

FIG. 2, illustrates the sensor 10 in an activated position. If the sensor 10 experiences a predetermined longitudinal acceleration 26, the trigger slides within the housing 14 until the projection reaches the opening 16. The projection 22 then "pops" through the opening 16 such that the projection can encounter a switch 28 as further described below.

Once the projection 22 extends through the opening 16, the trigger 18 is held in place by the continual angular acceleration 24 of the rotating drive line 12. Further, the resilient member 20 is preferably of sufficient resilience to return the projection 22 within housing 14 (FIG. 1) once the angular acceleration 24 falls below a predetermined acceleration. This allows the sensor 10 to automatically reset itself and thus allows further use without the necessity of replacement or disassembly to manfully reset the sensor 10. This allows "counting" of the number of times the vibration level exceeds the level. However, the resilient member 20 can be of sufficient resilience to maintain the projection 22 in the extended position even after cessation of the angular acceleration 24. This could provide a tamper proof indication that the sensor 10 has undergone an unacceptable level of vibration at least once.

The extension of the projection 22 through the opening 16 activates switch 28. Switch 28 is preferably a small switch such as a known piezoelectric switch activatable by extension of the projection 22 through the opening 16. The switch 28 preferably awakes and activates a transmitter 32 which sends a signal 34, such as an RF signal, to a remote warning device 34. Preferably, the housing 14, switch 28, and transmitter 30 are hermetically sealed against the elements. Again, as the sensor 10 is preferably fabricated using micro machining technology the entire sensor 10 can be a single hermetically sealed integrated circuit chip. Although a remote warning device 34 is shown, it will be realized that the warning device 34 can be similarly hard-wired to the sensor 10.

Figure 3:
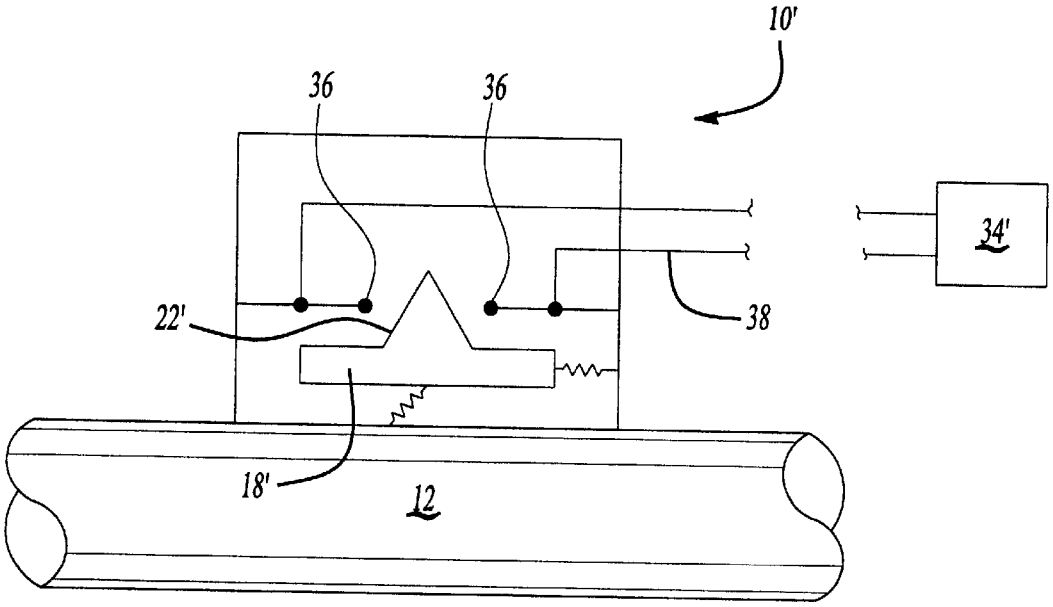
FIG. 3 is an alternate embodiment of the vibration sensor according to the present invention.

FIG. 3 illustrates an alternate embodiment of the vibration sensor according to the present invention shown in the activated position. Although a remote warning device 34 is described above, it will be realized that a warning device 34' can be hard wired to the sensor 10'. The sensor 10' is similarly activated as described above, however, in this embodiment, the trigger 18' is configured to close an electric circuit 38 when the projection 22' encounter contacts 36. The warning device 34' of FIG. 3, can thus be directly activated. This embodiment is also applicable to micro machining technology as the sensor 10', contacts 36, and circuits 38 can fabricated upon an integrated circuit chip.

The foregoing description is to be exemplary rather than defined by the limitations within. Obviously, many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vibration sensor comprising:

a housing having an actuation surface;

a moveable trigger within said housing, said moveable trigger having a projection; and a resilient member which restrains said movable trigger, said resilient member overcomable by a predetermined vibration level such that said projection is extendable into contact with said actuation surface.

2. The vibration sensor as recited in claim 1, wherein said resilient member is overcome by a predetermined longitudinal acceleration.

3. The vibration sensor as recited in claim 1, wherein said resilient member returns said projection to within said housing below a predetermined angular acceleration.

4. The vibration sensor as recited in claim 1, wherein said surface further includes an opening, and a warning device is activatable by extension of said projection through said opening.

5. The vibration sensor as recited in claim 4, further comprises a piezoelectric switch activatable by extension of said projection through said opening.

6. The vibration sensor as recited in claim 4, wherein said projection closes a circuit upon extension of said projection through said opening.

7. The vibration sensor as recited in claim 1, wherein said vibration sensor is hermetically sealed.

8. The vibration sensor as recited in claim 1, wherein said vibration sensor is micro machined.

9. A drive line vibration sensor comprising:

a housing having an opening;

a slidable trigger within said housing, said slidable trigger having a projection;

a resilient member which restrains said trigger, said resilient member overcomable by a predetermined longitudinal vibration such that said projection is extendable through said opening; and a warning device activatable upon extension of said projection through said opening.

10. The vibration sensor as recited in claim 9, wherein said resilient member returns said projection to within said housing below a predetermined angular acceleration.

11. The vibration sensor as recited in claim 9, wherein said warning device is remotely activatable.

12. The vibration sensor as recited in claim 9, wherein said warning device is remotely activatable by an RF transmitter, said RF transmitter activatable by extension of said projection through said opening.

13. The vibration sensor as recited in claim 9, wherein said warning device is activatable by a piezoelectric switch, said piezoelectric switch activatable by extension of said projection through said opening.

14. A drive line assembly comprising:

a drive line including a shaft;

a vibration sensor attached to said shaft, said vibration sensor including a housing having an opening;

a slidable trigger within said housing, said slidable trigger having a projection;

a resilient member which restrains said trigger against a predetermined axial acceleration of said shaft, said resilient member overcomable by vibration above said predetermined axial acceleration such that said trigger is movable to allow said projection to extend through said opening; and a warning device activatable upon extension of said projection through said opening.

15. The drive line as recited in claim 14, wherein said warning device is remotely activatable.

16. The drive line as recited in claim 14, wherein said vibration sensor is hermetically sealed.

17. The drive line as recited in claim 14, wherein said vibration sensor is micro machined.

18. The drive line as recited in claim 14, wherein said vibration sensor is integral to said shaft.

19. The drive line as recited in claim 14 wherein said trigger closes a contact to activate said warning device.

20. The vibration sensor as recited in claim 9 wherein said trigger closes a contact to activate said warning device.

* * * * *